United States Patent [19]

Batalorf, Jr.

[11] Patent Number: 4,750,750

[45] Date of Patent: Jun. 14, 1988

[54] SOCKET DRIVE ADAPTER

[76] Inventor: Jarrold Batalorf, Jr., RD #2, Box 898, Boyertown, Pa. 19512

[21] Appl. No.: 28,670

[22] Filed: Mar. 20, 1987

[51] Int. Cl.[4] ..... B25F 3/00

[52] U.S. Cl. ..... 279/1 A; D8/29; 81/177.85; 408/239 A

[58] Field of Search ..... 279/1 A; 408/239 A, 408/241 R; 81/177.85; D8/29

[56] References Cited

U.S. PATENT DOCUMENTS

D. 245,395 8/1977 Cognevich ..... D8/29 X

D. 260,355 8/1987 Buzzell ..... D8/29 X 1,864,466 6/1932 Peterson ..... 81/177.85 X

*Primary Examiner*—Gil Weidenfeld

*Assistant Examiner*—Steven C. Bishop

*Attorney, Agent, or Firm*—Leonard M. Quittner

[57] ABSTRACT

A socket drive adapter comprised of a shank on one end adapted to be received by a drill chuck and a square socket driver on its other end. The driver includes a ball detent that, by maneuvering a spring biased trigger mechanism, will releaseably secure a socket over the driver and prevent axial movement therebetween. Provision is also made to apply torque to the adapter by means of a hand held wrench.

2 Claims, 1 Drawing Sheet

FIG. 1
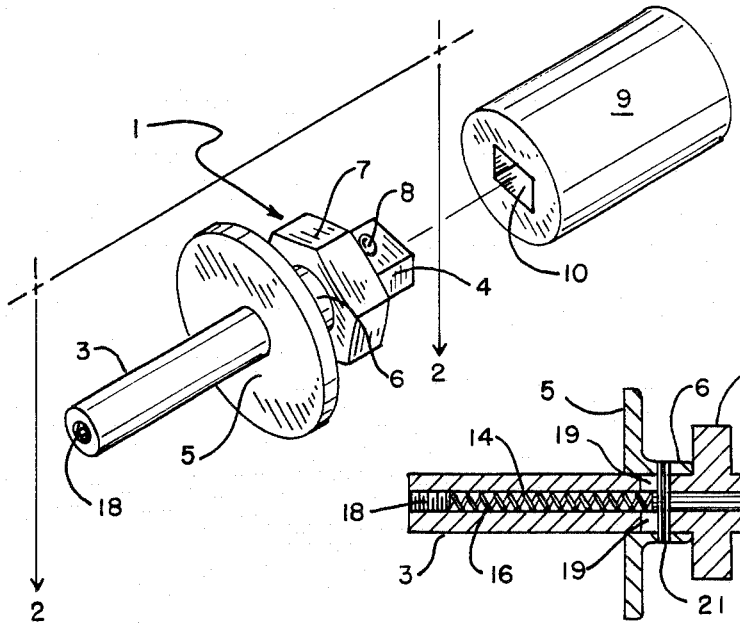
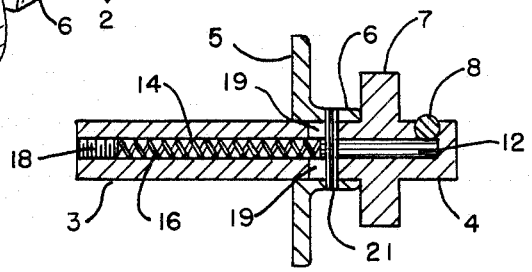
FIG. 2
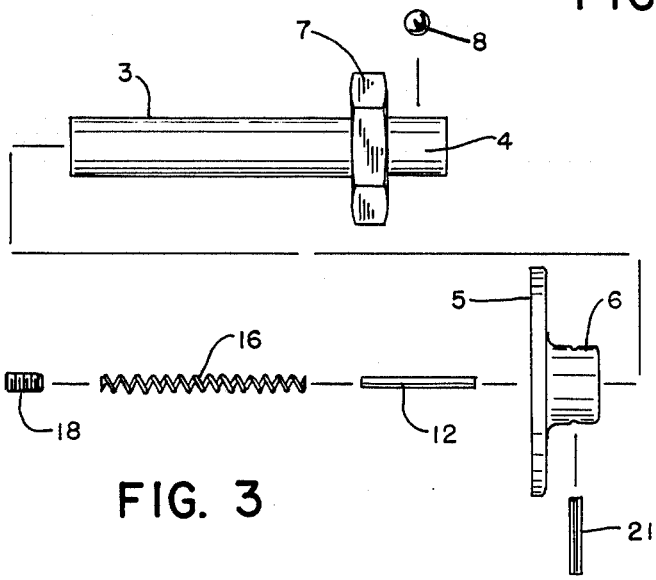
FIG. 3

SOCKET DRIVE ADAPTER

CROSS REFERENCE

There are no cross references to or any related applications.

FEDERALLY SPONSORED RIGHTS

The invention herein was made without any federal sponsorship or contribution.

BACKGROUND OF THE INVENTION

1. Field of the Invention

This invention relates to means for tightening or loosening threaded fastening elements such as nuts and bolts, and, more particularly this invention relates to an adapter for attaching a socket to a hand drill so that the drill may be used to loosen or tighten bolts and nuts or be used as a speed or torque wrench.

2. Description of the Prior Art

The device of the present invention is an adapter that permits a socket to be operably connected with a drill so the drill may be used to loosen or fasten nuts and bolts. Such an adapter is especially useful with electric drills and especially cordless portable electric drills since it allows loosening or tightening machine parts in awkward or crowded spaces in which it is difficult to manipulate other tools.

Since the socket is power driven when used with an electric drill, it is not only possible to operate the device with one hand, but it also permits the device to be used as an speed or torque wrench as, for example, when backing off nuts that have become "frozen" to the threads of a bolt.

Adapters for securing sockets to various type wrenches including ratchet wrenches are well-known in the prior art. Many of these devices make use of a spring-loaded ball detent which provides a releasable friction fit to hold the socket losely in position with respect to the adapter. One failing in these devices is that any pulling force away from a workpiece can unseat the socket. In contrast, the device of this invention provides a positive lock that will prevent axial movement of the socket with respect to the adapter once they are properly seated into each other.

Another useful feature of this invention is the provision of a gripping surface adapted to be engaged by a hand wrench. This permits a hand wrench to be used for auxiliary purposes, such as, for example, setting the final torque on a nut or bolt, or assisting a power drill in unloosening a stubborn nut.

SUMMARY OF THE INVENTION

Accordingly, it is an object of this invention to provide an adapter that operatively engages a socket with a drill.

Another object of this invention is to provide means for securing a socket from axial movement when mounted on a drill driver adapter.

Another object of this invention is to provide an adapter that may be used to drive a socket either by a power drill or a hand held wrench.

These and other objects of this invention will be made clear in connection with the accompanying drawings.

BRIEF DESCRIPTION OF THE DRAWINGS

FIG. 1 is a perspective view of the device of this invention positioned to receive a socket;

FIG. 2 is a sectional view of the device of this invention taken in plane 2—2 of FIG. 1; and FIG. 3 is an expanded assembly drawing showing the elements of the device of this invention.

DETAILED DESCRIPTION OF THE DRAWINGS

In FIG. 1 there is illustrated the socket drive adapter (1) of this invention. The body portion of the drive adapter (1) is comprised of a shank (3) at one end adapted to be received by a drill chuck (not shown) and at its other end by a square head driver (4). Intermediate the axial ends of the drive adapter (1) is mounted a finger grip (5) and a wrench grip (7). The finger grip (5) is shown as an annular disk mounted for axial movement on the shank (3). The finger grip (5) carries a flange (6) which surrounds and is free to move axially on the shank (3). The purpose of the flange (6) is to mount and guide the axial movement of the finger grip (5) on the shank (3).

The wrench grip (7) is fixedly attached to the shank (3) and, while shown in FIG. 1 as a hexmount, it could be any radially extending collar which has planer surfaces to provide gripping faces for a wrench.

The square head driver (4) carries a ball detent (8) which is normally secured in the latching position, that is, with the ball detent (8) extending beyond the perphery of the square head driver (4).

As illustrated in FIG. 1, the socket drive adapter is shown aligned to receive a socket (9) by fitting the square socket drive (10) over the square head driver (4) and locking it with ball detent (8) to prevent relative axial movement between these the socket (9) and adapter (1).

The details of operation of the socket drive adapter (1) are illustrated in more detail in FIGS. 2 and 3. Here it can be seen that the radial movement of the ball detent (8) relative to the shank (3) is controlled by the axial movement of latch pin (12) which is free for axial movement within a drilled passageway (14) in the shank (3). A spring (16) biases the latch pin (12) into a position beneath the ball detent (8) to secure the ball (8) in its radially extended or locked position. The spring (16) and latch pin (12) are contained within the drilled passageway (14) by means securing plug (18) which may either be tapped or friction fitted into the end of the drilled passageway (14).

A radial slot (19) is machined into the shank (3) axially extending a short distance under the flange (6). The slot (19) permits a pin (21) to pass through holes in the flange (6), through the latch pin (12) and into the opposite side of flange (6) so as to lock movement of the flange (6) to the latch pin (12). The slot (19) also provides for limited axial movement of the pin (21).

From the foregoing description, it can be understood that when it is desired to mount a socket (9) onto the socket drive adapter (1) of this invention, the finger grip (5) is axially moved away from the socket (9) carrying latch pin (12) with it and permitting ball detent (8) to retract beneath the surface of the square head driver (4). The socket drive (10) of the socket (9) is then inserted over the driver (4) and, when properly positioned and aligned, the finger grip (5) is released and compression spring (16) moves the latch pin (12), carrying with it the pin (21), flange (6), and finger grip (5), to force the ball detent (8) above the surface of the driver. This secures the ball detent (8) in seated engagement with the interior of socket drive (10).

As readily can be understood by anyone familiar with power tools, the socket drive adapter of this invention will permit nuts to be driven or loosened as by a reversable electric drill. The shank (3) can be inserted into a drill chuck and, after a socket has been secured over the driver (4) a nut may be driven or loosened by selecting the direction of rotation of the electric drill. The invention has particular utility when used with a cordless electric drill since it permits access to bolts which might otherwise be difficult to loosen or tighten with more conventional tools.

The wrench grip (7) is provided to permit using a wrench either to break a stuborn nut loose or provide proper torquing of a nut after it has been driven into a locked position.

It can be understood that the device of this invention readily converts an electric drill to function as a speed or torque wrench or to remove or tighten machine parts such as lug nuts, engine bolts, shock bolts, drive lag bolts, and general machinery nuts and bolts. In addition to being useful with a socket, it should be understood that the invention has equal aplicability with closed foot or open end socket wrenches and hex or other special drive sockets.

A special feature of this invention is that a socket may be secured in axial engagement with the driver (4) of the socket drive adapter (1). This prevents the socket from disengaging from the driver head (4) as might otherwise occur, for example, when a stuborn nut is being loosened or backed off. To this extent, the ball detent mechanism of this invention differs from those commonly shown in the prior art where the ball detent is simply spring biased to permit a socket either to be positioned over or withdrawn from the driver head and held in position by frictional engagement. In contrast, the device of this invention locks the socket in a position from which it can not be removed unless the latch pin (12) is withdrawn by movement of the finger grip (5).

I claim:

1. An adapter for mechanically linking a socket wrench with a drill to facilitate loosening or tightening threaded elements, such as bolts or nuts, in which a shank is adapted, at a first end, to be received by a chuck of a drill and, at a second end, fitted with a driver adapted to seat in torque transmitting relationship with a socket, including means to secure the socket in fixed axial relation to the shank, and means adapted to be engaged and gripped by a wrench;

the means to secure the socket comprising:

an annular flange mounted for axial sliding movement over the shank;

an axial passageway extending from the first end substantially to the second end of the shank;

a radial passageway in the driver extending from the surface of the driver to the axial passageway adapted to receive and retain a ball for movement therein;

an orifice in the radial passageway having a diameter less than the diameter of the ball adapted to retain the ball within the radial passageway but large enough to permit a portion of the ball to protrude above the surface of the driver;

a latch pin in the axial passageway extending from the radial passageway to a position radially inwardly from the annular flange;

spring bias means adapted to urge the latch pin into a position under the ball and to secure the ball in a protruding beyond the surface of the driver;

linkage pin means for operatively connecting the flange to the latch pin;

a pair of diametrically opposed, axially oriented, slots in the shank to permit limited axial movement of the linkage pin along the axis of the adapter through a distance at least equal to the radius of the ball; and an element operatively associated with the flange to be gripped and moved by the fingers of a hand;

the means adapted to be engaged and gripped by a wrench comprising a flat surfaced collar secured in surrounding relationship to the shank.

2. An adapter according to claim 1 wherein the element to be gripped by the fingers is an annular disk.

* * * * *